US010858870B2

(12) United States Patent
Gherardi

(10) Patent No.: US 10,858,870 B2
(45) Date of Patent: Dec. 8, 2020

(54) HINGE DEVICE WITH THE POSSIBILITY OF AJAR OR BREATHER OPENING

(71) Applicant: C.M.I. CERNIERE MECCANICHE INDUSTRIALI S.R.L., Valsamoggia (IT)

(72) Inventor: Eros Gherardi, Bologna (IT)

(73) Assignee: C.M.I. CERNIERE MECCANICHE INDUSTRIALI S.R.L.

( * ) Notice: Subject to any disclaimer, the term of this patent is extended or adjusted under 35 U.S.C. 154(b) by 36 days.

(21) Appl. No.: 15/772,913

(22) PCT Filed: Nov. 8, 2016

(86) PCT No.: PCT/EP2016/076989
§ 371 (c)(1),
(2) Date: May 2, 2018

(87) PCT Pub. No.: WO2017/081013
PCT Pub. Date: May 18, 2017

(65) Prior Publication Data

US 2018/0320424 A1 Nov. 8, 2018

(30) Foreign Application Priority Data

Nov. 10, 2015 (IT) ..... 102015000070943

(51) Int. Cl.
*E05D 11/00* (2006.01)
*E05D 7/086* (2006.01)
(Continued)

(52) U.S. Cl.
CPC ..... *E05D 7/086* (2013.01); *E05D 11/087* (2013.01); *E05F 1/1261* (2013.01);
(Continued)

(58) Field of Classification Search
CPC ..... F24C 15/02; F24C 15/026; F24C 15/027; E05D 7/08; E05D 7/081; E05D 7/086;
(Continued)

(56) References Cited

U.S. PATENT DOCUMENTS 3,712,287 A * 1/1973 Summers, Jr. ..... F24C 15/023 126/191
3,749,080 A * 7/1973 Kleinhenn ..... F24C 15/023 126/191

(Continued)

FOREIGN PATENT DOCUMENTS

EP 2453091 5/2012

OTHER PUBLICATIONS

International Search Report and Written Opinion of the International Searching Authority Application No. PCT/EP2016/076989 Completed: Jan. 19, 2017; dated Jan. 30, 2017 10 pages.

*Primary Examiner* — Emily M Morgan
(74) *Attorney, Agent, or Firm* — Ware, Fressola, Maguire & Barber LLP

(57) ABSTRACT

A hinge device includes a first connection means (3) configured to fixed to a structure or frame and rotatably connected to a second connection means (5) configured to fixed to a door device (1) comprises at least one interconnecting means (7) connected to a sliding means (13) and a friction means (17) with at least one friction sliding block (25) secured to the sliding means (13) and sliding along a respective sliding wall (27) of the first connection means (3) and parallel to a direction of translation of the sliding means (13), wherein at least one arrest means (19) is fixed to or made in the first connection means (3) in proximity to a sliding wall (27) to abut with the sliding means (13) to arrest its stroke towards the closing of the door or of the shutter in correspondence an ajar or breather opening condition (S).

6 Claims, 6 Drawing Sheets

(51) Int. Cl.

| | |
|---|---|
| ***E05F 1/12*** | (2006.01) |
| ***F24C 15/02*** | (2006.01) |
| ***E05D 11/08*** | (2006.01) |
| *A47L 15/42* | (2006.01) |

(52) U.S. Cl.
CPC ..... *F24C 15/023* (2013.01); *A47L 15/4261* (2013.01); *E05Y 2201/214* (2013.01); *E05Y 2201/224* (2013.01); *E05Y 2201/24* (2013.01); *E05Y 2201/26* (2013.01); *E05Y 2600/45* (2013.01); *E05Y 2800/296* (2013.01); *E05Y 2800/75* (2013.01); *E05Y 2900/304* (2013.01); *E05Y 2900/308* (2013.01)

(58) Field of Classification Search
CPC ..... E05D 1/12; E05D 1/1246; E05D 1/1253; E05D 1/1261; E05D 1/08; E05D 11/1028; E05D 11/105; E05D 11/00; E05D 11/08; E05F 1/08; E05F 1/12
USPC ..... 403/113, 111, 116
See application file for complete search history.

(56) References Cited

U.S. PATENT DOCUMENTS

| | | | | |
|---|---|---|---|---|
| 2003/0213098 | A1* | 11/2003 | Cummins | E05F 1/1276 16/286 |
| 2014/0208542 | A1* | 7/2014 | White | E05D 7/12 16/261 |
| 2014/0345082 | A1* | 11/2014 | Collene | E05F 1/1058 16/58 |
| 2015/0096148 | A1* | 4/2015 | Gherardi | E05D 11/08 16/289 |

* cited by examiner

FIG.2
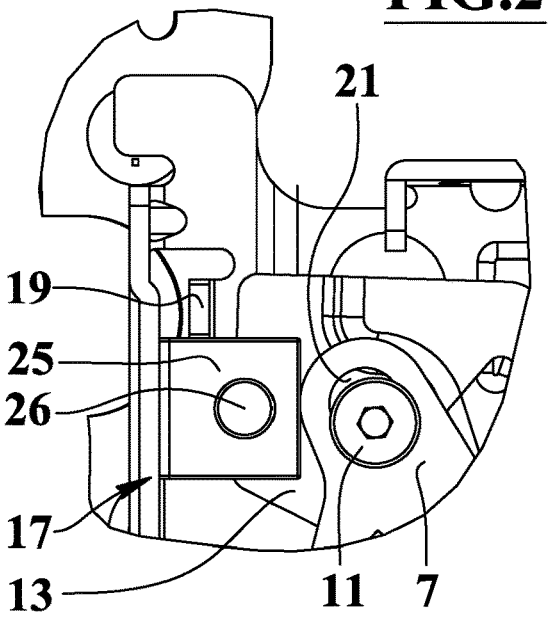
FIG.3
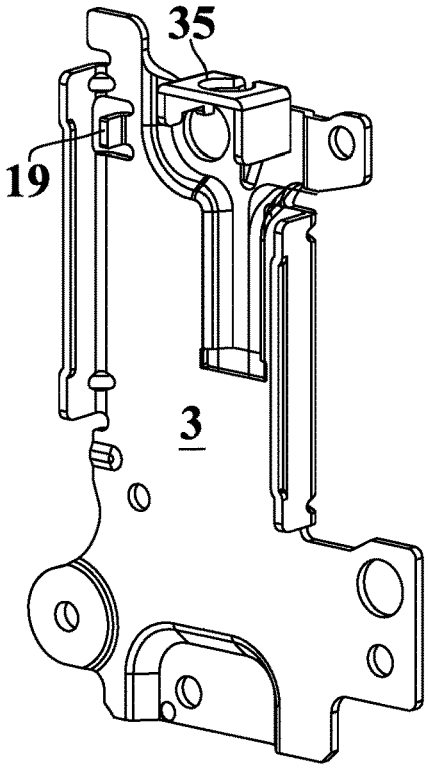
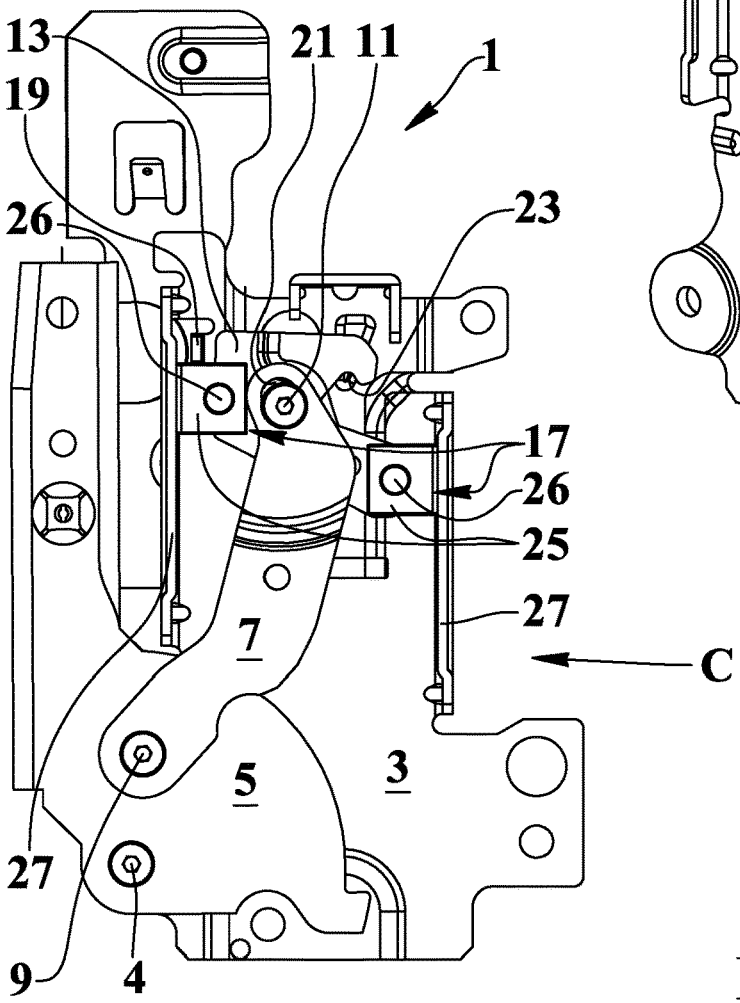
FIG.1

FIG.7
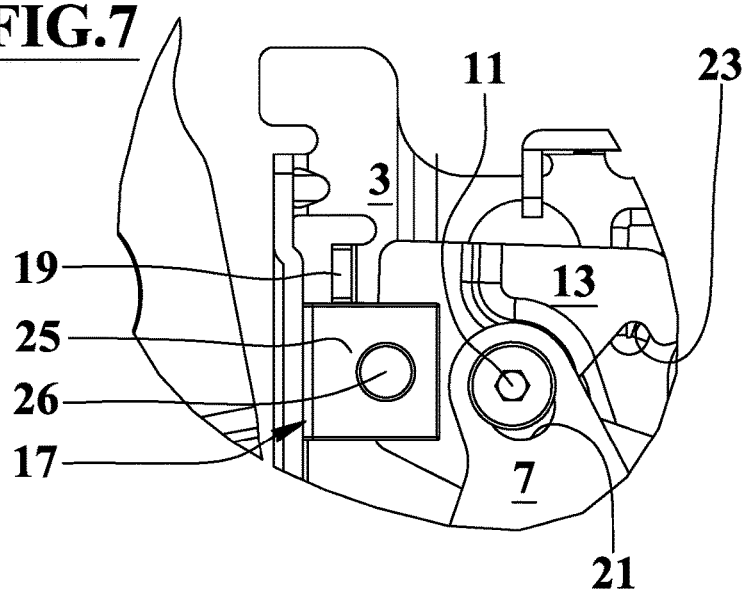
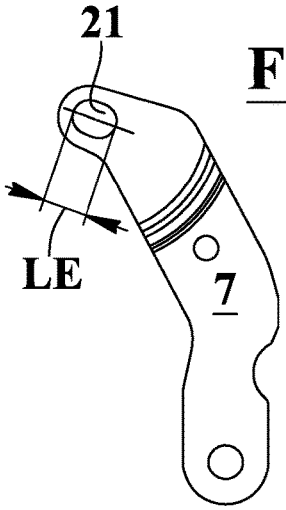
FIG.5
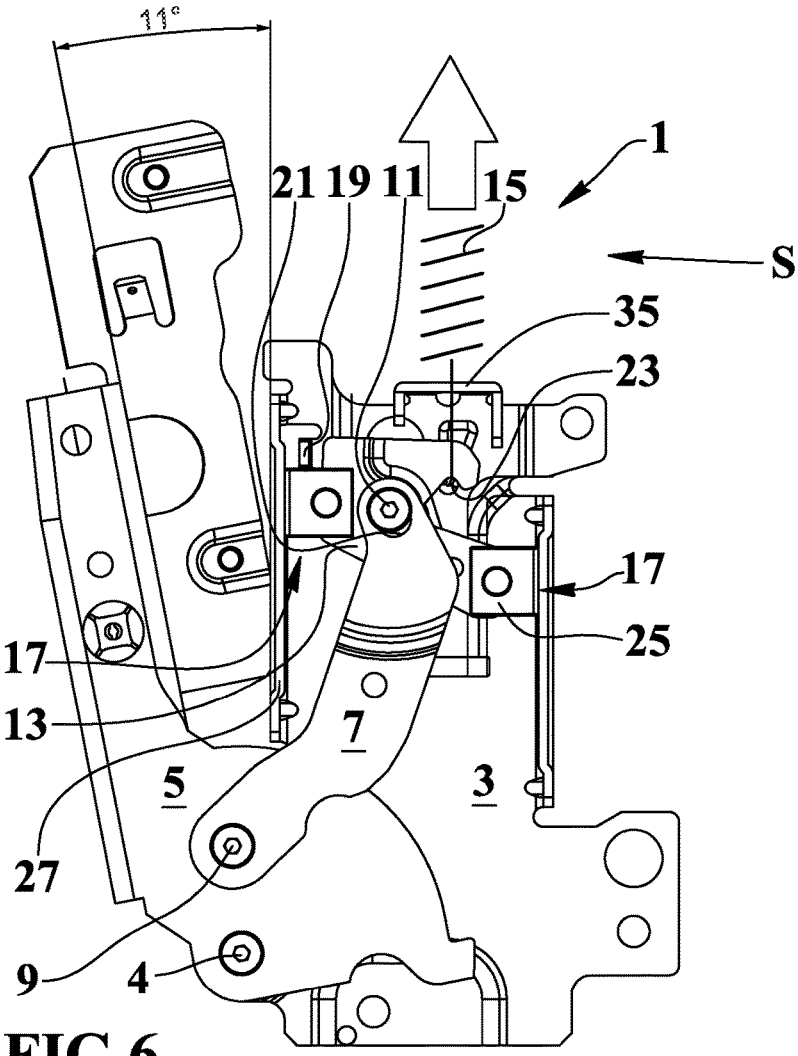
FIG.6
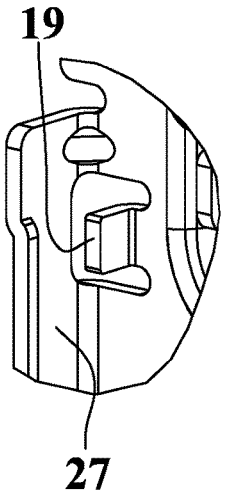
FIG.4

HINGE DEVICE WITH THE POSSIBILITY OF AJAR OR BREATHER OPENING

TECHNICAL FIELD

The present invention relates to the field concerning the hinges for dishwasher and for other apparatuses such as, for example, for ovens or the like and in particular it refers to a hinge device with the possibility of breather opening to allow the outflow of steam at the end of washing, or during or after cooking. The breather opening is a condition of the door or shutter that corresponds to an ajar condition of the door or shutter.

PRIOR ART

The known dishwasher hinges allow the opening and closing of the door having a horizontal and lower axis of rotation, balancing the weight of said door. At the end of wash operations, the dishwashers perform a final heating phase of the dishes after which the user should open the door, at least a few degrees, to allow the outflow of steam. Omitting the opening of the door at the right time, the steam remains inside the dishwasher and, as a result of the cooling, the steam condenses wetting again the dishes and the interior of the dishwasher. Often happens that the user forgets to open the door or that the opening is insufficient for example due to the elastic closing force applied to the door by the elastic bodies of the known hinges.

A further disadvantage of the known hinges consists in that they can allow an unintentional opening of the door starting from the opening to some small degree to allow for the outflow of steam from the steam breather and then having the door unintentionally continue opening by itself so as to open totally and to end up occupying part of the floor area, thereby creating a tripping hazard for unsuspecting bystanders.

Electric control for door locks are known and sometimes they can provide a small elastic opening push. Such locks can be applied to the dishwasher to program the opening at the end of the washing cycles but the elastic force of the hinges, required to balance the weight of the door, prevents the latter to be open enough to allow venting.

DISCLOSURE OF INVENTION

One object of the present invention is to propose a hinge device with the possibility of breather opening that, in the early stages of opening or up to a few degrees of opening, for example from about 8° to about 20° preferably about 11°, don't transmit to the door elastic closing force and/or friction forces that oppose the opening.

Another object is to propose a hinge device that from the breather opening condition to the total opening condition and vice versa, is able to balance the weight of the door and to brake the rotation thereof.

Another object of the invention is to propose a hinge device that is able to provide the door with a small elastic opening push towards said opening breather condition to facilitate the initial door opening phase in response to the opening of the lock.

BRIEF DESCRIPTION OF THE DRAWINGS

The characteristics of the invention are shown in the following with particular reference to the attached drawings in which:

FIG. 1 shows a front and partial view of the hinge device with the possibility of breather opening, object of the present invention, in a closed condition;

FIG. 2 shows an enlarged view of a detail of FIG. 1;

FIG. 3 shows an axonometric isometric view of a first connection means of FIG. 1;

FIG. 4 shows an enlarged view of a detail of FIG. 3 to better illustrate respective arrest means;

FIG. 5 shows a front and enlarged view of an interconnection means of FIG. 1;

FIG. 6 illustrates a front view of the hinge device with the possibility of breather opening of FIG. 1 in an open breather condition of 11° and in which respective elastic means are shown in a schematic and partial way;

FIG. 7 shows an enlarged view of a detail of FIG. 6;

DETAILED DESCRIPTION

Figure 9:
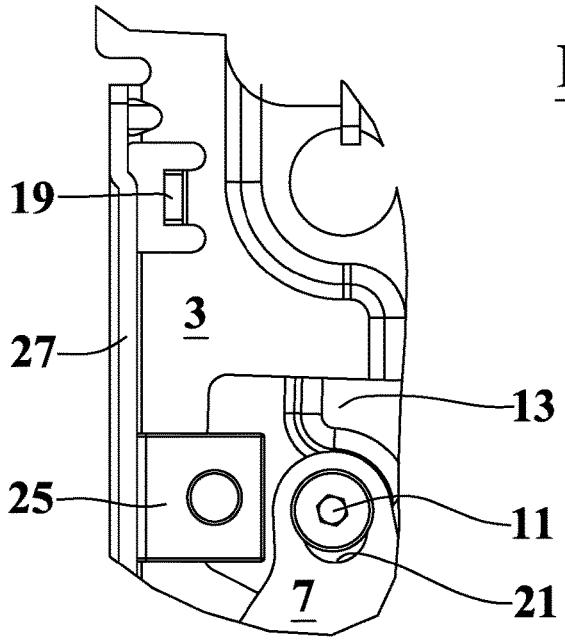
FIG. 9 is an enlarged view of a detail of FIG. 8.
Figure 8:
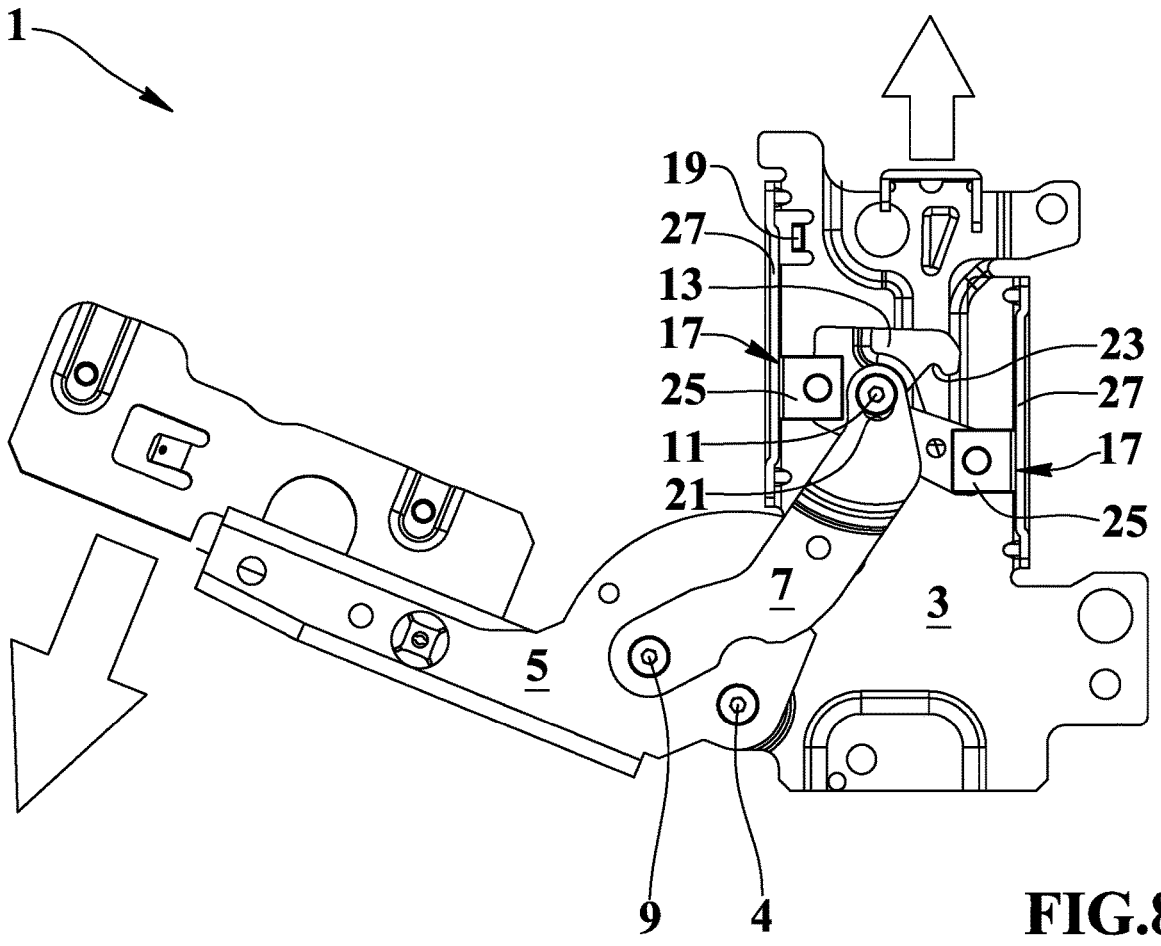
FIG. 8 shows a front view of the hinge device with the possibility of breather opening of FIG. 1 in a not fully open condition and in a phase of rotation toward the complete opening, shown by the large tilted arrow, wherein the elastic force carried by the elastic means, not shown, is represented by a smaller tilted arrow pointing vertically upwards.
Figure 11:
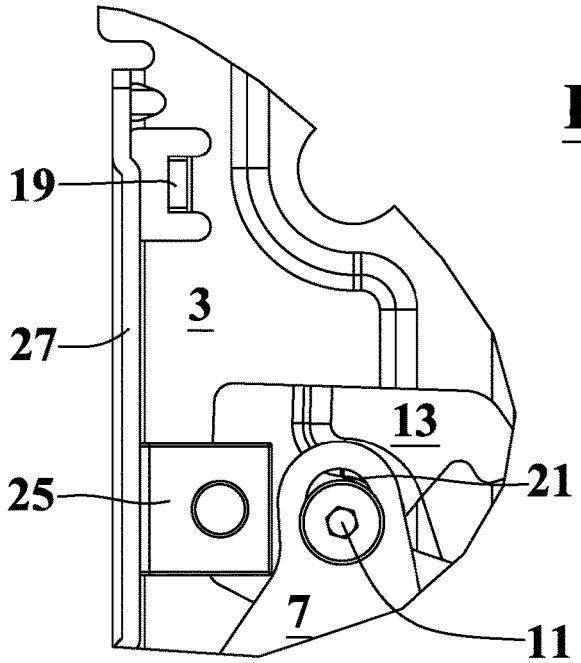
FIG. 11 shows an enlarged view of a detail of FIG. 10.
Figure 10:
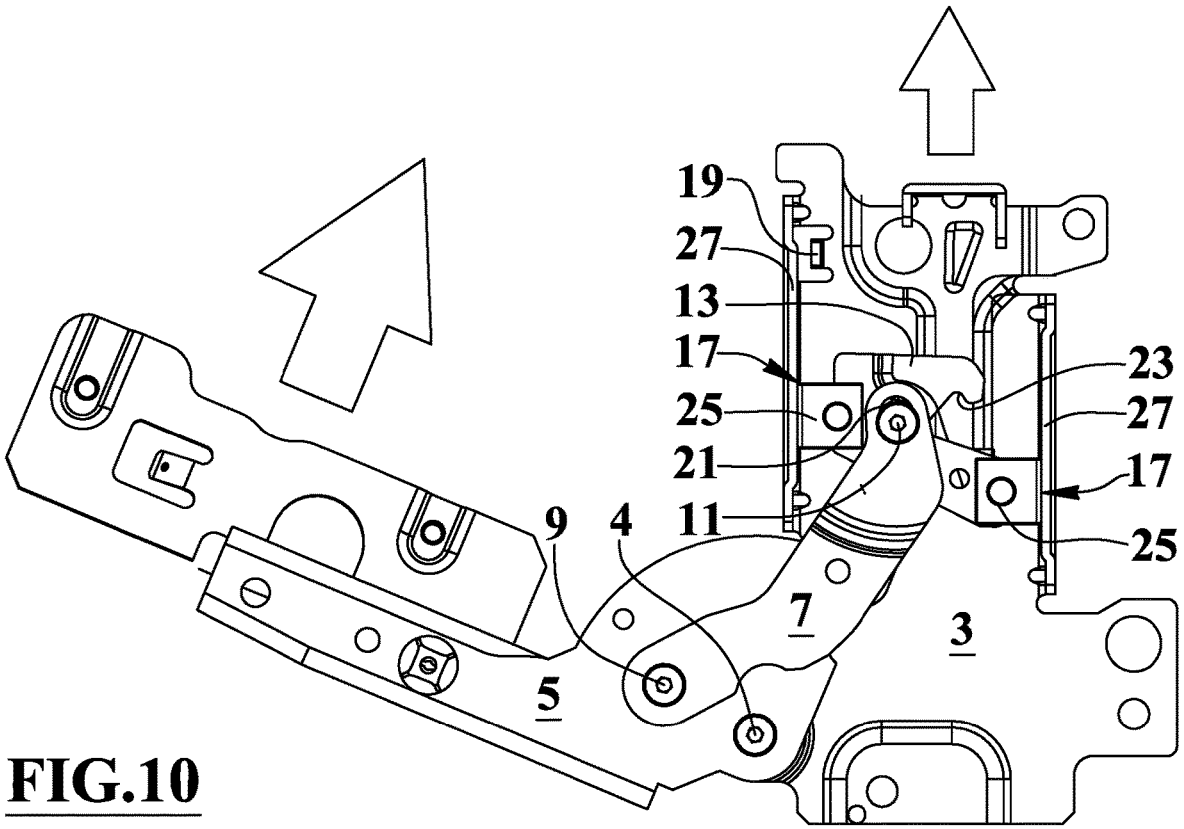
FIG. 10 shows a front view of the hinge device with the possibility of breather opening of FIG. 1 in a not fully opened condition, corresponding to that of FIG. 8 but in a rotation condition toward the closure shown by the large arrow tilted, wherein the elastic force carried by elastic means, not shown, is represented by a smaller surrounded arrow pointing vertically upwards.

With reference to figures from 1 to 11, 1 indicates the hinge device with the possibility of breather opening object of the present invention comprising a first connection means 3 assigned to be fixed to a structure or frame of a dishwasher or of another device with a door having horizontal and bottom axis of rotation.

The first connection arm or means 3 is rotatably connected, by a hinge pin 4 whose axis of rotation defines the rotation axis of the door, to a second connection arm or means 5 configured to fixed to said door or shutter of the dishwasher or of the other appliance.

The hinge device 1 also comprises at least one interconnection means 7 consisting of a shaped connecting rod having a first end connected to the second connection means 5 by a first connecting pin 9 and a second end connected, by a second connecting pin 11, to a sliding body or means 13 constrained to translate along the first connection arm or means 3.

Said sliding body or means 13 is connected to, or is provided with, an elastic means 15, schematically and partially shown in FIG. 6, and the sliding body or means 13 is connected to a friction element or means 17 assigned to transmit to the second connection means 5, by the interconnection means 7, respectively an elastic force directed in the direction of the extreme closing condition C of the door or shutter and a friction force directed in opposition to the rotation of the door or shutter.

The device 1 also comprises an arrest lock or means 19 assigned to abut with the sliding means 13 or preferably with a member of the friction means 17 in an end portion of the closing rotation of the door or shutter arresting the sliding means 13 in correspondence of an open breather condition S of the door or shutter putting this door or shutter, in the open breather condition S, out of the action of the elastic closure force and by the frictional force produced by the friction means. The second connecting pin 11 is rigidly fixed to the sliding means 13 and it is housed with clearance in a respective seat 21 made in the second end of the interconnection means 7 and said seat 21 is shaped in the form of a slot elongated in the motion direction of the sliding means towards the closed condition C of the door or shutter. Alternatively, the second connecting pin 11 may instead be rigidly secured to the second end of the interconnection means 7 and be housed with clearance in a respective seat 21 obtained in the sliding means 13.

The shape of the seat 21 for the second connecting pin 11 allows the connection means 5 and the door or shutter to carry out the final portion of closing rotation of the door or shutter from the open breather condition S to the extreme closing condition C and the corresponding reverse rotation while the sliding body or means 13 abut with the arrest means 19 which prevent further translation of the sliding body or means 13 and as such serves as an arrest lock 19.

The friction means 17 provides the second connection means 5 with a force friction higher in intensity or in module of the elastic force given to the second connection means 5 by the elastic means 15.

The sliding means 13 consists of a rocker arm whose median portion is engaged to the second connecting pin 11. The friction means 17 comprise at least one friction sliding block 25, preferably two as shown in FIGS. 1 to 11, and placed at opposite positions with respect to the second connecting pin 11. Each friction sliding block 25 is secured to the sliding means 13 by a respective pin and slides along a sliding surface (FIG. 4) of a respective sliding wall 27 of the first connection means 3, said sliding surface of the respective sliding wall 27 is parallel to the direction of translation of the sliding means 13.

Each sliding surface of the respective sliding wall 27 is parallel to the connecting pins 9, 11 and to each pin (26) securing the respective friction sliding block 25; the sliding means 13 is provided with a hook 23 for the elastic means 15 placed, with respect to the second connecting pin 11, in a manner for transmitting to each friction sliding block 25 an abutment torque pushing it 25 against the sliding surface of the respective sliding wall 27. The elastic means 15 are, for example, of a compressed coil spring type having one end in abutment with a shelf or support 35 of the first connection means and having the opposite end acting, by a not shown internal rod guiding the spring, on the hook 23 of the sliding means 13.

The arrest means 19 is fixed to or made n the first connection means 3 in proximity to the at least one sliding wall 27 to abut with the sliding means 13 or preferably with one of the at least one friction sliding block 25, as shown for example by the left-hand friction means 17 in FIG. 6 and n detail n FIG. 7, arresting its stroke towards the closing of the door or of the shutter n correspondence of the breather opening condition S.

Preferably the hook 23 for the elastic means 15 is placed in the sliding means 13 at the side of the latter 13 opposite, with respect to the second connection pin 11, to the friction sliding block 25 that is assigned to abut with the arrest means 19.

As shown in FIGS. 1-11, the hook 23 and the straight line of action of the elastic force of the elastic means are offset with respect to a geometric straight line parallel to the motion of translation of the sliding means 13 and passing through the second connecting pin 11, and the at least one friction sliding block 25 are mutually offset so that the torque generated by the offset of the hook 23 in respect to the connecting pin 11 is transmitted to, e.g., two friction sliding blocks 25 pressing them against the respective sliding walls 27. In the breather opening condition S the angle of rotation of the second connection means 5 and of the door compared to the closed condition C is generally between 8° and 20° and preferably it is about 11° as shown in FIG. 6; the longitudinal extension (LE) of the slot shaped seat 21 is such as to allow the rotation of the door of this latter angle when the arrest means 19 abut with the sliding means 13.

The operation of the device 1 provides that the door or shutter can achieve the breather opening condition S starting from the closed condition C through a slight push produced by an electrically controlled lock and it provides that the door can follow the opposite route through manual push or inertia.

This is allowed by the longitudinal extension of the slot shaped seat 21, that allows the free rotation of the door between the closed condition C and breather condition S putting the door out of the spring forces and friction applied to the sliding means 13 while the translation of the latter is blocked by the arrest means 19.

Figure 12:
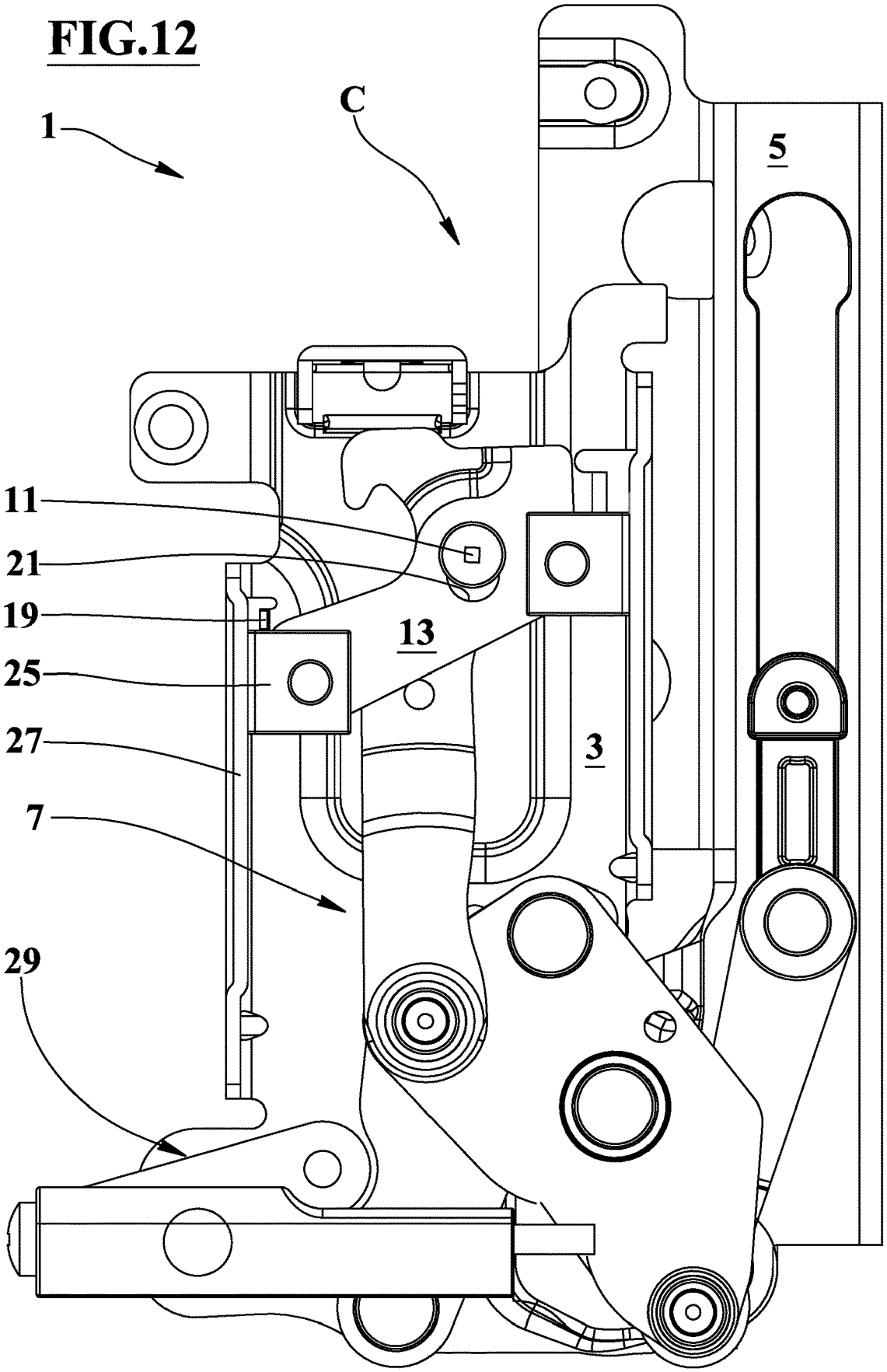
FIG. 12 shows a front view and in the closed condition of a variant of the device of FIG. 1.
Figure 13:
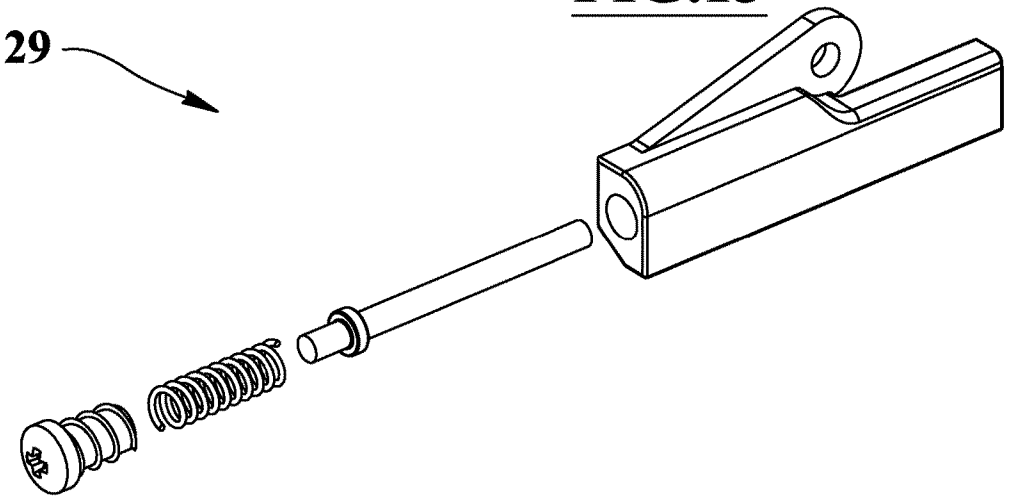
FIGS. 13 and 14 show, by their respective points of view, axonometric and exploded views of a pusher means of FIG. 12.
Figure 14:
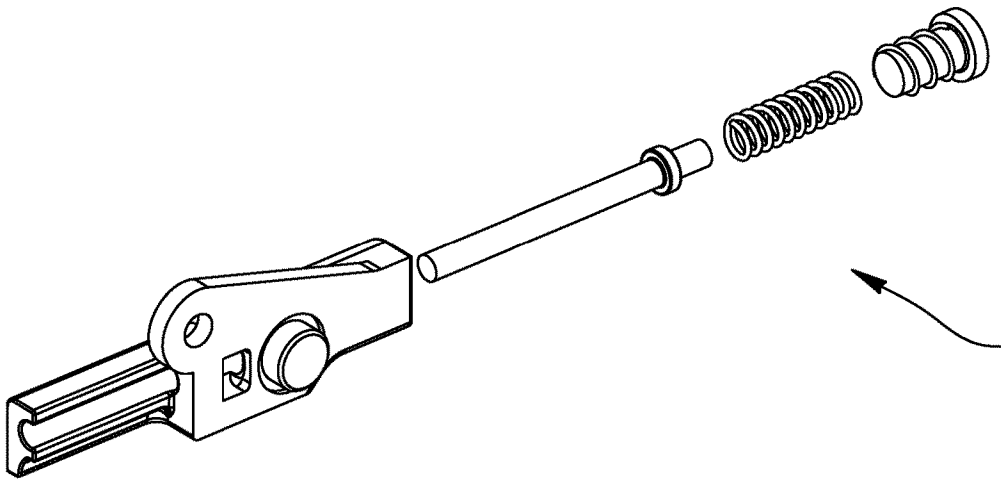

The interconnecting member or means 7 of the device of the variant of FIGS. 12 to 14, consists of a connecting rod or, as shown in FIG. 12, in a connection chain connecting rods and rocker.

This variant comprises a pusher means 29 equipped with an elastic means and assigned to act onto the interconnection means 7 with an elastic force intended to facilitate or to enable the achievement of the breather condition S of the door or shutter starting from the closed condition C. The pusher means 29 comprises a respective body fixed to the first connection means 3 and provided with a longitudinal cavity which houses a helical spring operating in compression and acting axially on a movable rod in said cavity whose outer end transmits the elastic force of the spring to the interconnection means 7 to provide the door with an elastic opening force from the closed condition C to the breather condition S.

The operation of this variant provides that, after the electric actuated opening of the lock door, the elastic force of the pusher means 29 allows or aids the rotation of the door from the closed condition C to the breather condition S.

The invention claimed is:

1. Hinge device having an open, ajar, and closed positions, comprising:

a first connection arm configured to be fixed to a structure, the first connection arm having a sliding wall;

a second connection arm configured to be fixed to a door;

a hinge pin directly and rotatably connecting the first connection arm and the second connection arm;

at least one interconnecting member having a first end with a first connecting pin, and a second end with a slot shaped seat, the first connecting pin rotatably connecting the at least one interconnecting member to the second connection arm;

a sliding body with a second connecting pin, the second connecting pin housed within the slot shaped seat, the sliding body constrained to translate along the first connection arm, the sliding body having an elastic spring;

at least one friction sliding block with a constraint pin, the constraint pin rotatably connecting the friction block to the sliding body, the at least one friction sliding block sliding on the sliding wall of the first connection arm; and an arrest lock adjacent the at least one sliding wall, situated to abut the friction sliding block, wherein the spring provides an elastic force on the sliding body opposite the second connecting pin from the constraint pin, the force in a direction of an extreme closing condition of the door, wherein the sliding of the at least one friction sliding block creates a frictional force in a direction opposite the elastic force, and wherein the arrest lock abuts the friction sliding block, and the slot shaped seat allows the door to rotate between an ajar position and a closed position of the door.

2. Device according to claim 1, wherein the second connecting pin is engaged with a median portion of the sliding body.

3. Device according to claim 1, wherein the sliding body is provided with a hook at an end opposite the at least one friction sliding block, the elastic spring is attached to the hook, wherein the elastic force pulls on the sliding body to pivot about the constraint pin.

4. Device of claim 1, wherein the hook is placed at a side of the sliding body opposite the at least one friction sliding block.

5. Device according claim 1 wherein the interconnecting member (7) comprises a connecting rod or of a series of a connecting rod and a rocker arm.

6. Device according to claim 5 comprising a pusher (29) comprising an elastic spring configured to act on the interconnecting member (7) with an elastic force configured to allow achievement of the ajar position of the door.

* * * * *